United States Patent [19]

Purinton, Jr.

[11] Patent Number: 4,543,131

[45] **Date of Patent: * Sep. 24, 1985**

[54] AQUEOUS CROSSLINKED GELLED PIGS FOR CLEANING PIPELINES

[75] Inventor: Robert J. Purinton, Jr., Tulsa, Okla.

[73] Assignee: The Dow Chemical Company, Midland, Mich.

[ * ] Notice: The portion of the term of this patent subsequent to Mar. 10, 1998 has been disclaimed.

[21] Appl. No.: 591,080

[22] Filed: Mar. 19, 1984

Related U.S. Application Data

[63] Continuation of Ser. No. 241,962, Mar. 9, 1981, abandoned, which is a continuation-in-part of Ser. No. 96,106, Nov. 20, 1979, abandoned, Ser. No. 106,784, Dec. 26, 1979, abandoned, and Ser. No. 122,536, Feb. 19, 1980, Pat. No. 4,254,559.

[51] Int. Cl.[4] ..... B08B 9/04

[52] U.S. Cl. ..... 134/8; 15/104.06 R; 134/22.11; 134/22.14; 134/26; 137/15; 252/8.55 B

[58] Field of Search ..... 134/8, 22.11, 22.14, 134/26; 15/104.06 R; 137/1, 15; 252/8.55 B, 316, 315.1

[56] References Cited

U.S. PATENT DOCUMENTS

| | | | |
|---|---|---|---|
| 2,744,880 | 5/1956 | Brown | 15/104.06 R X |
| 3,058,909 | 10/1962 | Kern | 252/8.55 R X |
| 3,209,771 | 10/1965 | Gogarty et al. | 137/1 |
| 3,392,115 | 7/1968 | Shibe et al. | 252/8.55 B |
| 3,523,826 | 8/1970 | Lissant | 134/22.11 |
| 3,818,991 | 6/1974 | Nimerick | 166/283 |
| 3,853,771 | 12/1974 | Felmann et al. | 252/8.55 B |
| 3,974,077 | 8/1976 | Free | 252/316 X |
| 4,003,393 | 1/1977 | Jaggard et al. | 137/15 |
| 4,216,026 | 8/1980 | Scott | 134/8 X |
| 4,254,559 | 3/1981 | Purinton | 34/9 |

*Primary Examiner*—Marc L. Caroff

[57] ABSTRACT

Pipeline interiors are cleaned by passing a gelled pig containing an aqueous, cross-linked gelled galactomannan gum, or derivative thereof, through the pipeline. Additives can be included in the gelled pig to enhance stability, cleaning ability, etc. The gelled pigs are particularly effective when used in pig trains containing one or more chemical pig segments in the train.

18 Claims, No Drawings

AQUEOUS CROSSLINKED GELLED PIGS FOR CLEANING PIPELINES

CROSS-REFERENCE TO RELATED APPLICATIONS

This application is a continuation of Ser. No. 241,962 which was filed on Mar. 9, 1981, now abandoned, and which was in turn a continuation-in-part of my earlier copending applications: Ser. No. 096,106 filed Nov. 20, 1979, entitled "Gelled Pigs for Cleaning and Sanitizing Pipelines", now abandoned,; Ser. No. 106,784 filed Dec. 26, 1979, entitled "Aqueous Crosslinked Gelled Pigs for Cleaning Pipelines", now abandoned,; and Ser. No. 122,536 filed Feb. 19, 1980, (now U.S. Pat. No. 4,254,559; issued Mar. 10, 1981) entitled "Method for Drying Pipelines". The disclosure of each of these latter three applications is incorporated herein by reference.

BACKGROUND OF THE INVENTION

1. Field of the Invention

This invention pertains to a novel method for cleaning pipelines using aqueous, cross-linked gelled pigs.

2. Declaration of the Prior Art

Pipeline efficiency and volume can be lost by scale build up in the interior lining of the pipe. Mechanical pigs and/or gelled chemical pigs have been used to remove the scale. The mechanical pigs are normally solid bullet-shaped devices which have wire brushes or abrasive surfaces to physically abrade the scale interior of the pipe. The gelled chemical pigs, on the other hand, remove the surface deposits by dissolution and/or by picking up loose debris as they pass through the pipeline.

A new aqueous gelled pig containing bactericides was described in my patent application, Ser. No. 096,106. The gelled pigs described there are extremely effective in removing bacteria-containing scale from pipelines. As one example, a pipeline laden with sulfate-reducing bacteria was cleaned from the interior of a pipeline by passing through it a gelled pig whose composition comprised a borate cross-linked hydroxypropyl guar gum containing an organic quaternary ammonium salt as a bactericide. Some of these bactericide-containing gelled pigs are species of the generic invention described below.

A new method of drying pipelines was described in my patent application, Ser. No. 122,536. This method comprised sequentially passing through the line (a) an aqueous crosslinked gelled pig, (b) a fluid mobility buffer comprising a non-crosslinked gelled pig, (b) a fluid mobility buffer comprising a non-crosslinked gelled alkanol of from one to three carbon atoms, and (c) a dessicating amount of a liquid alkanol of from one to three carbon atoms. As an example, a pipeline was dried by sequentially passing through it (a) a borate crosslinked hydroxypropyl guar gelled pig, (b) a fluid mobility buffer comprising methanol thickened with hydroxypropylcellulose, and (c) methanol.

SUMMARY OF THE INVENTION

A new method of cleaning the interior of pipelines has been discovered. The new method comprises passing an aqueous gelled pig containing an aqueous, crosslinked gelled galactomannan gum, or derivative thereof, through said pipeline.

The aqueous gelled crosslinked pigs used in this invention are superior to other pigs which utilize, for example, polyacrylamides and the like for the gel matrix. This superiority is shown in their shear stability, ease of hydration in water, and the convenience with which the gelled pigs are broken when the job is complete. This facilitates waste disposal and enhances the commercial viability.

The aqueous gelled crosslinked pigs used in this invention are also superior to other pigs which utilize xanthan gum for the gel matrix (crosslinked or uncrosslinked). This superiority is shown in the ease with which the present pigs are pushed through the line in a "plug flow" manner, the ability of the present pigs to sustain a liquid/gel interface, and the ability to effectively isolate or separate one fluid from another in the line. The novel gelled pigs have unusually good integrity and substantially eliminate or prevent channeling or fluid by-pass in moving pig trains having multiple chemical segments (i.e. elements or sections). Their integrity also enables one to clean lines which are filled with liquid without first evacuating the lines; the present gelled pigs are used in such instance as the leading segment of a pig train and the liquid contents of the line are merely displaced ahead of the train without contamination of materials behind the leading gelled pig. This capacity to form a "tight" chemical seal in the line is of considerable commercial importance and appears to be unique. Another unique feature (over xanthan gum pigs) is the capacity of the gels to "heal" and reform when the gel has been temporarily damaged (thinned) by high shear, an event that occurs when the gels encounter a restriction in the line. Applicant's borate crosslinked gels are particularly effective in this regard. The aqueous crosslinked gels also have a capacity to suspend and carry high levels of particulate solids.

DETAILED DESCRIPTION

The aqueouus-based pig compositions comprise water, a galactomannan gum or derivative thereof as a thickening agent, and crosslinker. The pig compositions may optionally contain other additives such as an abrasive solid in particulate form (e.g. sand) which promote the cleaning ability of the pig as it passes through the pipeline, or other conventional additives which stabilize the pig, etc. Galactomannan gums and derivatives thereof are well known thickeners for water and water-based fluids. Examples of such gums include natural gums (e.g. guar gum, locust bean gum, endosperm seed gums, and the like) and derivatives thereof (e.g. hydroxyalkyl galactomannans, carboxyalkyl galactomannans, hydroxyalkyl carboxyalkyl galactomannans, etc.). These are known classes of compounds and essentially any member can be used in the present invention. The most common commercial galactomannan gums are guar, hydroxypropyl guar, hydroxyethyl guar, hydroxyethyl carboxymethyl guar, and carboxymethyl guar gums. Because of their commercial availability, these gums are preferred thickeners, and of these, guar gum and hydroxypropyl guar gum are the most preferred. It should be noted that in some references the galactomannan gums are referred to as polysaccharide and polysaccharide derivatives. Such thickeners are normally used in amounts of from about 40 to about 150 pounds per 1000 gallons of water (i.e. from about 0.5 to about 1.8 percent by wt). They are preferably used in amounts of from about 40 to about 80 pounds per 1000 gallons of water (i.e. from about 0.5 to about 1.0 percent by wt).

The actual amount used, however, can be adjusted to convenience by the practitioner.

Aqueous compositions containing the above thickeners are normally cross-linked using a polyvalent metal ion. The cross-linker is normally added as a soluble salt or as a soluble organometallic compound in an amount sufficient to achieve the desired amount of cross-linking. Borates, organotitanates, and organozirconium salts are commonly used. The cross-linking ability of such compounds is pH dependent in many instances (e.g. the borate systems). This factor presents a convenient mechanism for dealing with the thickened fluids in a non-crosslinked form until the properties of a crosslinked fluid are desired. In the non-crosslinked state, the thickened aqueous fluids are normally pumpable at conventional pressures. Substantially elevated pressures are required to pump the fluids in the crosslinked state.

The galactomannan gums and crosslinkers are, as noted, known classes of compounds which are illustrated in U.S. Pat. No. 3,058,909, U.S. Pat. No. 3,974,077, U.S. Pat. No. 3,818,991, U.S. Pat. No. 3,779,914, and U.S. Pat. No. 3,696,035, the disclosures of which are incorporated by reference. Reference is also made to the disclosure in the text of Davidson and Sittig, "Water-soluble Resins" Second Edition (1968) and the text by Smith and Montgomery, "The Chemistry of Plant Gums and Mucilages", Biograph Series No. 141 (1959) as well as the text by Davidson, "Handbook of Water-Soluble Gums and Resins" (1980).

Normally, the gelled pigs are formulated outside of the pipeline as a pumpable mass and the crosslinker or cross-linker/activator is added to the pumpable mass as it is being pumped into the pipeline. This "on-the-fly" approach has several procedural advantages, not the least of which is ease of placement at convenient low pressures. In this manner, the pig forms a crosslinked gel network after it enters the pipeline and conforms to the general shape and size of the pipeline. To illustrate, an aqueous pig comprised of a borate cross-linked polysaccharide (or polysaccharide derivative) gel is a preferred pig composition where the pig may be subjected to considerable shear. Such pig formations are conveniently prepared and used by first blending boric acid (about 2 to 4 pounds) with an aqueous slurry or solution of the polysaccharide or polysaccharide derivative (about 60 to 80 pounds) to form a pumpable homogeneous mass. Sufficient base (e.g. aqueous NaOH) is then metered in to change the pH to a basic pH (pH 8.5–10 normally) as the homogeneous aqueous mass is being pumped into the pipeline. The quantities of boric acid and polysaccharide or derivative are per 1000 gallons of water in each instance in the pipeline. The gel-time of these borate-crosslinked systems is easily adjusted by the quantity of base added (crosslinking occurs faster at a higher pH).

After the pig has been formed in the pipeline, it is normally driven through the pipeline by the driving force of a fluid under pressure. This fluid may be a gas or a liquid and will vary depending upon the needs of the user. For example, if the user wishes to leave the pipeline in a dry, empty state, one would normally use a dry inert gas (e.g. nitrogen, carbon dioxide, ethane, propane, liquified petroleum gas, etc.) If the user desires to refill the pipeline with a product, the pig could be driven with a liquid product, (e.g. crude oil, gasoline, etc.) so long as the product did not adversely affect the properties of the pig before its job is complete or substantially complete. Or in many instances the user may want the line cleaned, passivated and filled with fresh water for temporary "storage" of the line (e.g. a preoperational cleaning).

Normally the pigs are formulated and used at ambient temperatures or below and are pumped through the pipelines at pressures sufficient to move the pig at a reasonable rate. Temperatures are, therefore, normally below about 140° F. Pressures are normally below about 1500 psig. The predominant number of pipelines will normally be cleaned at pressures less than 500 psig. Linear flow rates of up to about 10 feet/second are normally satisfactory from a commercial cleaning standpoint. However, linear flow rates of up to about 5 feet/second are generally preferred and rates of from about 0.75 to about 1.25 are most preferred.

The size and shape of the pipeline is basically irrelevant because the gelled pigs are able to be pumped for prolonged distances and their shapes adjust to fit the size of the pipeline during conditions of use. This makes the gelled pig extremely effective because stalactites and stalagmites in the pipeline do not cause its destruction by ripping and tearing it apart as they do solid mechanical pigs.

The aqueous gelled pigs can be used alone or as an element of a pig train in the pipeline cleaning process. In the latter instance, the aqueous gelled pig is preceded and/or followed by other chemical pig segments or mechanical pigs. Such chemical pig segments can be of the same or different compositions and can include various additives (e.g. corrosion inhibitors, bactericides, passivation agents, etc.). These chemical segments are usually liquid or gels.

For example, a pig train can be formed having an aqueous gelled pig according to the instant invention as the leading segment followed by a bactericide-containing water-based gelled pig. This combination can be very effective in cleaning and sanitizing pipelines. As another example, a pig train having an aqueous gelled pig according to the instant invention as the leading segment followed by a mobility buffer comprising a non-crosslinked gelled alkanol of from 1 to 3 carbon atoms followed by a desiccating amount of a liquid alkanol of from 1 to 3 carbon atoms can be very effective in drying pipelines. As another example, a pig train can be formed having aqueous crosslinked gelled pigs of the present invention as the leading and trailing segments of the pig train sandwiching in a crosslinked xanthan gum pig(s) or a liquid or gelled organic solvent (e.g. kerosene, perchloroethylene, toluene, etc.). This embodiment of having a pig train with one or more chemical pig segments sandwiched between aqueous crosslinked gelled pigs of the present invention is a preferred embodiment when there is a need to clean a line filled or partially filled with liquid and/or to use a liquid under pressure as the driving force for the pig train. Mechanical pigs (such as scrapers, swabs, squeegees, spheres, etc.) can also be advantageously included in the pig train in many instances. For example, one can include scraper pigs to dislodge scale and debris to be subsequently picked up and carried by an aqueous gel (e.g. a gel of the present invention, a crosslinked xanthan gum, etc.). As another example, squeegee pigs (e.g. foamed polyurethane pigs) can be included to physically separate chemical pig segments in the pig train and/or included as the trailing segment of the train. When the driving force for the pig train is a gas under pressure (e.g. nitrogen), it is advantageous to use one or more squeegee pigs at the end of the pig train to help prevent fluid by-pass (a potential problem, particularly in convoluted lines). Pig trains of multiple segments are envisioned and embodied in the scope of the present invention.

After the aqueous crosslinked gelled pig(s) has passed through the pipeline, it can be recovered and disposed of as such or "breakers" can be added to cause the crosslinked gelled pig to break and thereby lose its structure, viscosity, etc. As noted above, this is a very desirable property because it facilitates waste disposal. Additionally, in many instances the aqueous gelled pig is of essentially inconsequential volume relative to the volume of the "product" following it and does not adversely affect the material which follows. For example, a few hundred gallons of a pig used according to the instant invention and discharged into the hold of a ship transporting crude oil would not adversely affect the properties of the thousands of gallons of crude oil also present in the tanker.

Experimental:

The following examples will further illustrate the invention.

EXAMPLE 1

A 40 mile pipeline (6 inch inside diameter) was cleaned by passing through it sequentially (a) 2000 gallons of borate crosslinked aqueous gelled pig (pH 8.5–10) having 60 pounds of hydroxypropylguar per 1000 gallons water, (b) 1000 gallons fresh water, (c) 16,000 gallons of 15 percent hydrochloric acid, (d) 8000 gallons of a commercial passivator and neutralizer. Several polyurethane pigs were used in the job (i.e. in front of and behind the pig train and in between each chemical segment in the pig train). This pig train was driven through the pipeline with fresh water pumped at 90 gallons per minute. Samples of the pig were taken as it passed through the pipeline. Data obtained from such samples showed that the gelled aqueous pig retained its integrity throughout the 40 mile journey. An excellent cleaning job resulted from this treatment.

The line was then dried by running a pig train containing sequentially (a) 2500 gallons of a borate crosslinked aqueous gelled pig (pH 8.5–10) having 80 pounds of hydroxypropylguar per 1000 gallons of water and (b) methanol. Once again, several polyurethane pigs were used in the pig train as the leading and trailing segments and in between the gel and the methanol. The pig train was driven with nitrogen at a rate of about 1 foot/-second. Nitrogen flow was continued for a period after the train was pushed through the pipe. The pipe dew point was measured at −80° F. using a Bureau of Mines Dew Point Tester (manufactured by Chandler Engineering Company).

In Example 1 the pig train was driven through the pipeline at a rate of approximately 1 foot per second. This is a very satisfactory rate from a commercial standpoint, but rates up to about 5 feet per second or more have been used with success. The higher linear velocity trains normally require somewhat longer pigs or pig segments to achieve the same degree of cleaning (thought to be primarily a function of contact time) and to minimize the tendency of pig segments to mix if turbulent flow is encountered.

EXAMPLE 2

Approximately 60 feet of a 1-inch steel pipeline, containing 25 feet of clear polyvinyl chloride sections was filled with water, evacuated with compressed air, and then dried by passing through it the following pig train:

(1) A crosslinked gelled water pig was added first. It was prepared by mixing 12 gallons water, 354 grams of hydroxypropylguar, 16.5 grams boric acid, and lastly, 350 milliliters (mL.) of a 5 percent solution of sodium hydroxide in water. The sodium hydroxide was added on-the-fly as the pig was being pumped into the line. The pig crosslinked quickly (2–5 seconds) after entering the line to a firm gel.

(2) A gelled methanol pig was added next. It was prepared by blending 3.5 gallons methanol, 191 grams of hydroxypropylcellulose (average molecular weight of approximately 1 million) and 24 grams of solid sodium hydroxide.

(3) Lastly, 15 gallons of liquid methanol was added.

The pig train was then driven through the line at 1–2 feet per second with compressed nitrogen (approximately 231 standard cubic feet used).

Visual inspection of the line prior to drying showed the walls wet with water and small puddles in low points of the line. After drying with the pig train, the surface walls had a dew point of −19° F. as measured by the Bureau of Mines Dew Point Tester (manufactured by Chandler Engineering Company).

EXAMPLE 3

The effectiveness of a bactericide-gelled pig was evaluated by passing ten gallons of a gelled water pig containing 250 ppm of a commercial quaternary ammonium bactericide (Dowell M76) through a 65 foot test loop of one inch steel/one inch polyvinyl chloride pipe contaminated with river water laden with bacteria. The pig was driven through the line with fresh water at approximately six inches per second. Once the gel discharged from the line, the line was flushed with approximately 40 gallons of fresh water. Samples were taken from the line of river water, from the gelled pig, and from the flush water. Culture tests revealed an extremely high level of bacteria (greater than one million ppm bacteria/cubic centimeter) in the river water, no bacteria were detected in the gelled pig, and less than 10 ppm of bacteria per cubic centimeter in the flush water. The gelled pig was prepared by blending 60 pounds of hydroxypropyl guar and 3 pounds of boric acid and 250 ppm of the bactericide per thousand gallons of water and adjusting the pH of the solution to a pH of from 9–10 with aqueous sodium hydroxide. The system cross-linked as the pH became basic.

EXAMPLE 4

A 7000 foot section of 4 inch pipeline carrying raw natural gas was severely restricted by a very dense, nonporus, sulfide-containing deposit and miscellaneous particulate debris. The line was cleaned using two separate pig trains.

First, the line was filled with water (ca. 73 barrels). Then, 500 gallons of water thickened with 50 pounds of hydroxypropyl guar was pumped into the line followed by a squeegee (foamed polyurethane —8 pounds/cubic foot density), then 500 gallons of a borate crosslinked aqueous gelled pig (pH 8.5–10) containing 30 pounds of hydroxypropylguar. This pig train was then driven with water through the line at a rate of about 4 feet/-second. A tremendous volume of debris was removed. It took almost 95 barrels of water to refill the line.

A second pig train was launched into this line filled with water. This pig train contained (sequentially) 500 gallons of borate crosslinked gel (pH 8.5–10) having 30 pounds of hydroxypropylguar as the gel matrix, 500 gallons water, 4100 gallons of a dispersion of Dowell Sulfide Scale Remover (a unique commercial blend of inhibited sulfuric acid and formaldehyde—U.S. Pat. No. 4,220,550) and perchloroethylene, and sufficient water to fill the line. Polyurethane squeegees or their functional equivalent were again used at the beginning and end of the pig train and in between each chemical segment of the train except the crosslinked gel and water stage. After the line had soaked for about 5 hours the pig train was extended by charging 1000 gallons of an aqueous sodium citrate solution (passivator), 250 gallons of the borate-crosslinked aqueous gelled pig (described above), 300 gallons of a commercial passivator containing aqueous ammonium hydroxide, sodium nitrite and citric acid, 250 gallons of the borate-crosslinked aqueous gelled pig described above, and a squeegee pig or swab. This train was then pushed through the line with nitrogen at 2 feet/second.

Inspection of the line showed that greater than 90 percent of the dense deposit had been removed without the evolution of any gaseous hydrogen sulfide and the line was swept clean of loose debris.

EXAMPLE 5

A chemical pig train was used to chemically clean and dry over 10,000 feet of a new 6 inch (inside diameter) line scheduled to carry vinyl chloride monomer. The line was first filled with water which was then displaced with a pig train consisting of a squeegee pig, a borate-crosslinked aqueous gelled pig (60 pounds of hydroxypropylguar/1000 gallons of water; pH 8.5–10), water, a squeegee pig, 15 percent aqueous HCl, water, a squeegee pig, a borate-crosslinked aqueous gelled pig (as above), a commercial passivator containing aqueous ammonium hydroxide, sodium nitrite and citric acid, another borate-crosslinked auqeous gelled pig (as above), and a squeegee pig. This pig train was driven with nitrogen at a rate of about 10 feet/minute. Nitrogen flow was continued for about 60 minutes after the train was pushed from the line. The fluid seal provided by the borate-crosslinked aqueous gelled pig at the end of the train was so good that the train pushed virtually all of the liquid out of the line. The dew point measured −32° F. after the above treatment.

By way of comparison, it took several trucks of dry nitrogen to achieve the same dew point when an essentially identical line was cleaned without gelled pigs but using essentilly equivalent liquid reagents and mechanical pigs to precede, follow and separate the chemical pig segments. More importantly, perhaps, it took a period of days using this alternative procedure to dry the line rather than a matter of a few hours using the procedure and gels of the present invention.

EXAMPLE 6

A 5-mile long pig train was used to clean sand, rust and construction debris from a 36-inch (inside diameter) off-shore gas pipeline. The length of the line was approximately 280 miles. The sea water in the line was displaced ahead of the pig train containing 2000 barrels of a borate-crosslinked aqueous gelled pig containing 80 pounds of hydroxypropylguar/1000 gallons, 20,000 barrels of an aqueous crosslinked gel containing xanthan gum as the gel matrix, and 2000 barrels of a borate-crosslinked aqueous gel. The pig train also contained 4 or 5 mechanical scraper pigs distributed throughout the xanthan gum gels which loosened and circulated the debris and one mechanical scraper pig as the trailing segment of the pig train. The pig train was driven at a rate of 1 foot/second using fresh river water. Electronic equipment recorded the times at which the mechanical pigs arrived at the far end of the line; all were on schedule except for the final (trailing) mechanical pig which was several hours late. It is reasoned that drive water by-passed this final mechanical plug, a problem that is recurrent with the use of such plugs.

This cleaning job was an overwhelming success. It was estimated from the quantity of solid debris in the discharged gel that approximately 150 tons or more of material had been removed.

What is claimed is:

1. A method of cleaning the interior of a pipeline comprising passing an aqueous gel pig containing an aqueous crosslinked gelled galactomannan gum, or derivative thereof, through said pipeline in amounts and at a rate sufficient to remove contaminants from the interior of said pipeline.

2. The method defined by claim 1 wherein said galactomannan gum, or derivative thereof, is a guar gum or a hydroxypropyl guar gum.

3. The method defined by claim 2 wherein said galactomannan gum, or derivative thereof, is crosslinked with borate, organotitanate, or organozirconium ions.

4. The method defined by claim 3 wherein said galactomannan gum, or derivative thereof, is crosslinked with borate ions.

5. The method defined by claim 1 wherein said galactomannan gum, or derivative thereof, is present in said gelled pig in amounts of at least about 40 pounds per 1000 gallons of water.

6. The method defined by claim 1 wherein said gelled pig is passed through said pipeline at driving pressures of up to about 1500 psig at a rate of up to about 5 feet per second.

7. The method defined by claim 1 wherein said pipeline and its contents are at temperatures of up to about 140° F.

8. The method defined by claim 7 wherein said pipeline and its contents are at about ambient temperature.

9. The method defined by claim 8 wherein said gelled pig is passed through said pipeline at driving pressures of up to about 1500 psig at a rate of up to about 5 feet per second.

10. A method of cleaning the interior of a pipeline comprising passing an aqueous gelled pig containing an aqueous, crosslinked guar gum or hydroxypropyl guar gum through said pipeline at a driving force of up to about 1500 psig at a rate of up to about 5 feet per second and at a temperature of up to about 140° F. for said pipeline and its contents in amounts and at a rate sufficient to remove contaminants from the interior of said pipeline.

11. The method defined by claim 10 wherein said method is conducted at ambient temperature and wherein said gelled pig comprises hydroxypropyl guar gum in amounts of from about 40 to about 80 pounds per 1000 gallons of water crosslinked with borate ions at a pH of from about 8.5 to about 10.

12. The method defined by claim 11 wherein said aqueous gelled pig is passed through said pipeline at a rate of about 0.75 to about 1.25 feet per second.

13. The method defined by claims 1, 2, 3, 4, 5, or 6 wherein said aqueous gelled pig is at least one element of a pig train having a plurality of chemical pig elements.

14. The method defined by claim 13 wherein at least the leading element of the said pig train is said aqueous gelled pig.

15. The method defined by claim 13 wherein said pig train additionally comprises at least one mechanical pig.

16. The method defined by claim 13 wherein at least one of said aqueous gelled pig elements is preceded and/or followed by an aqueous gel or aqueous liquid.

17. The method defined by claim 13 wherein at least one of said aqueous gelled pig elements is preceded and/or followed by an aqueous gel.

18. The method defined by claim 13 wherein at least one of said aqueous gelled pig elements is preceded and/or followed by a liquid. 7

* * * * *